US005826382A

United States Patent [19]

Elsasser et al.

[11] Patent Number: 5,826,382

[45] Date of Patent: Oct. 27, 1998

[54] ELONGATED MEMBER OF EXTRUDED PLASTIC SUITABLE FOR FLOORING, DECKING, SEATING, AND LIKE USES

[75] Inventors: Glenn R. Elsasser; Frederick E. C. Wall, both of Winnipeg, Canada

[73] Assignee: Western Profiles Limited, Winnipeg, Canada

[21] Appl. No.: 769,670

[22] Filed: Dec. 19, 1996

[51] Int. Cl.[6] ..... E04F 11/16; E04F 15/00

[52] U.S. Cl. ..... 52/181; 52/177

[58] Field of Search ..... 52/177, 182, 188, 52/191, 8

[56] References Cited

U.S. PATENT DOCUMENTS

| | | | |
|---|---|---|---|
| 4,018,944 | 4/1977 | Hallstrom et al. | 52/177 X |
| 4,100,325 | 7/1978 | Summers et al. | 428/334 |
| 4,998,391 | 3/1991 | Connew | 52/181 X |
| 5,475,951 | 12/1995 | Utzowl | 52/177 |
| 5,613,339 | 3/1997 | Pollock | 52/177 X |

*Primary Examiner*—Christopher Kent
*Assistant Examiner*—Yvonne Horton-Richardson
*Attorney, Agent, or Firm*—Jones, Tullar & Cooper, P.C.

[57] ABSTRACT

An elongated member suitable for flooring, decking, or seating, having a top plate formed as an extrusion of plastic material suitable for overlying a support, wherein the top plate includes ribs constituted by protruding portions of parallel, spaced apart, elongated friction elements co-extruded therewith, the friction elements being formed of plastic having distinctly greater softness or flexibility than the main parts of the top plate and suitable for providing a non-slip surface. The member may include an elongated support formed as a relatively rigid extrusion of plastic material having a base plate with upstanding side flanges and a longitudinally extending upstanding support portion positioned between the flanges, the top plate overlying the support and having edge formations engaging the side flanges.

14 Claims, 2 Drawing Sheets

ELONGATED MEMBER OF EXTRUDED PLASTIC SUITABLE FOR FLOORING, DECKING, SEATING, AND LIKE USES

BACKGROUND OF THE INVENTION

1. Field of the Invention

The present invention relates to an elongated member made entirely or partially of extruded plastic, and suitable for the upper surface of decks, docks, or bench type seating, and for other uses, generally in walking, standing, or sitting areas.

2. Prior Art

There have been various prior proposals for using plastic extrusions for decking and like flooring needs, especially for outdoor use, for example as described in the following patents:

Canadian Patent No. 989,134, issued May 18, 1976 to Hassman;

Canadian Patent No. 1,190,717, issued Jul. 23, 1985, to Stanley et al.;

Canadian Patent Application No. 2,100,986, published Jan. 22, 1995, of Steadman; and Canadian Patent Application No. 2,108,425, published Apr. 15, 1995, of Bayly.

Also, U.S. Pat. No. 5,070,664, which issued Dec. 10, 1991 to Groh. et al., describes an extruded plastic structure for fitting onto wooden or steel benches to improve comfort and weather resistance.

The Canadian patents of Hassman and Stanley et al., and the Steadman application, describe structures formed of polyester resin or like material with glass fiber reinforcement, these structures being formed by pultrusion. The Bayly application describes a plastic channel type member, which seemingly might be extruded, although this does not appear to be mentioned.

A common drawback of plastic surfaces for decks and other walking areas is that these tend to be slippery, especially when wet. Some of these prior patents show ribs or other formations intended to provide a non-slip surface. Thus the structure shown in the Hassman patent has ribs on its upper surface, integrally formed of the same reinforced plastic material, and intended to prevent slipping. The Stanley et al. patent describes a non-skid feature provided by a grit surface applied to the upper face of the member during the pultrusion process. The Bayly application states that its flooring members can have textured surfaces so they will not be slippery when wet, although the nature of these surfaces is not given. The Groh et al. patent shows a structure with an overlying cap or "capstock" of between 15 and 25 mils in thickness, formed of a rigid vinyl resin, intended to improve weatherability, and which also has spaced apart, integrally formed, parallel ridges which provide a gripping surface.

These prior art non-skid features are believed to have some drawbacks. Thus, ribs of the type shown in the Hassman or Groh et al. patents provide little gripping effect in directions parallel to the ribs. In each case, the ribs are formed integrally with the surrounding material and thus have the same hardness or firmness. If the "capstock" of the Groh et al. patent were to be made of soft material it might have greater friction but would wear rapidly in the relatively thin areas between the ribs. Surfaces of the kind described in the Stanley et al patent, or in the Bayly application, are likely to be difficult to produce as part of an extrusion process. There exists a need for a flooring member which can easily be produced by extrusion, and which has a non-skid feature which is effective lengthwise of the member and not only in the cross direction.

SUMMARY OF THE INVENTION

The present invention overcomes these drawbacks by providing an elongated member suitable for flooring, decking, or seating, comprising a top plate formed as an extrusion of plastic material suitable for overlying a support, wherein the top plate has a non-slip surface provided by ribs constituted by protruding portions of parallel, spaced apart, elongated friction elements co-extruded with the top plate, these elements being formed from plastic material having distinctly greater softness or flexibility than the material forming the main part of the top plate which is exposed between the elements. The softness of the ribs in accordance with this invention is comparable to that of treads on shoes, and gives the ribs enhanced friction in the longitudinal direction, as well as in the transverse direction.

Preferably, the ribs protrude from the top plate between 0.02 and 0.05 inches.

The top plate preferably has inturned edge elements for engaging sides of the support. The support may be a wooden beam or bench, for example as shown in the aforesaid patent to Groh et al., but is preferably an extruded plastic member.

A preferred embodiment of the invention is an all plastic, all extruded, elongated member, for example a flooring member, comprising a top plate as described, and an elongated support formed as a relatively rigid extrusion of plastic material having a base plate with upstanding side flanges and a longitudinally extending upstanding support portion positioned between the flanges. The top plate rests on the support portion and bridges the gaps between the side flanges and the support portion; it has its inturned edge elements held by interengaging formations at the top of the side flanges.

BRIEF DESCRIPTION OF THE DRAWINGS

A preferred embodiment of the invention will now be described by way of example with reference to the accompanying drawings, in which.

DETAILED DESCRIPTION

Figure 1:
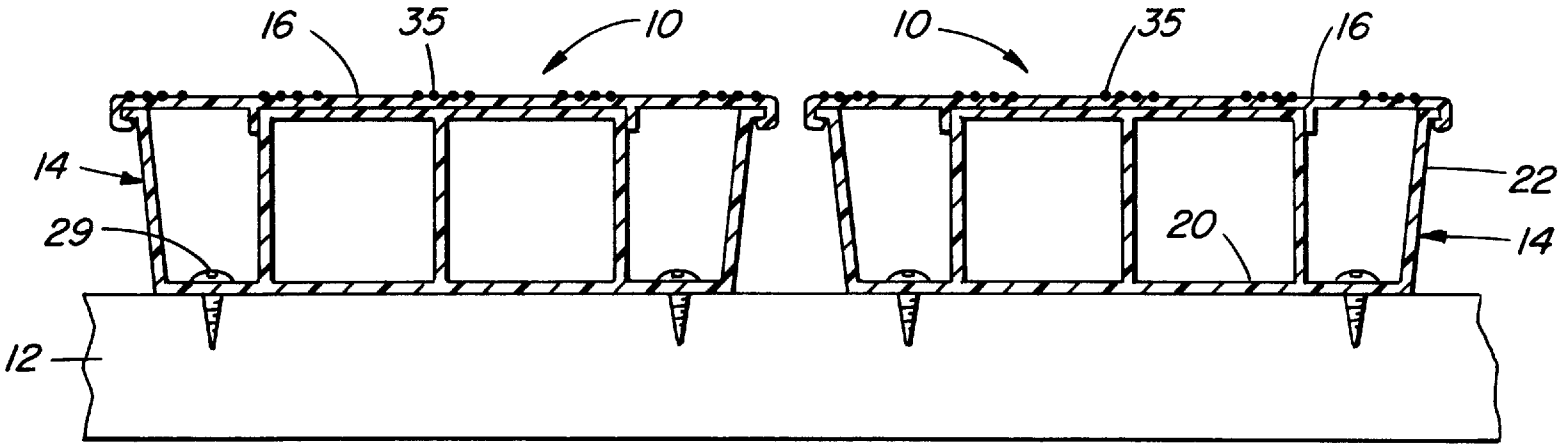
FIG. 1 is a cross-sectional view through a portion of a deck using flooring members according to this invention.

In FIG. 1 two elongated members 10 in accordance with this invention are shown supported on a wooden joist 12. Each member is made of two parts, shown separately in FIGS. 4 and 5. These parts include a support 14, shown in FIG. 5, and a top plate 16 shown in FIG. 4. Each of these parts is integrally formed by extrusion, and the whole of the support, and most of the top plate, are formed of rigid PVC (polyvinyl chloride). The width of each part is between 5 and 6 inches, and the wall thickness of each part is about 0.1 inches or 2.5 mm.

It will be seen that the support has a base plate 20 with upstanding side flanges 22, and that upper edges of the flanges have outwardly projecting lips 22*a*. A central region of the support has an upstanding support portion 24 extending longitudinally of the member, this having a height almost the same as that of the flanges. The support portion has two outer upstanding webs 26 and a central upstanding web 27, these webs being bridged by a roof member 28, providing an upper support surface.

The base plate 20 is fastened to the joists 12 by screws 29 accessible between the flanges 22 and the outer webs 26. Afterwards, the top plate 16 is applied.

Figure 4:
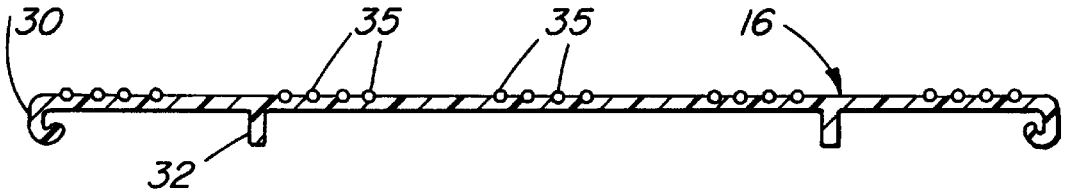
FIGS. 4 and 5 are enlarged sectional views of the main components of the flooring member.
Figure 5:
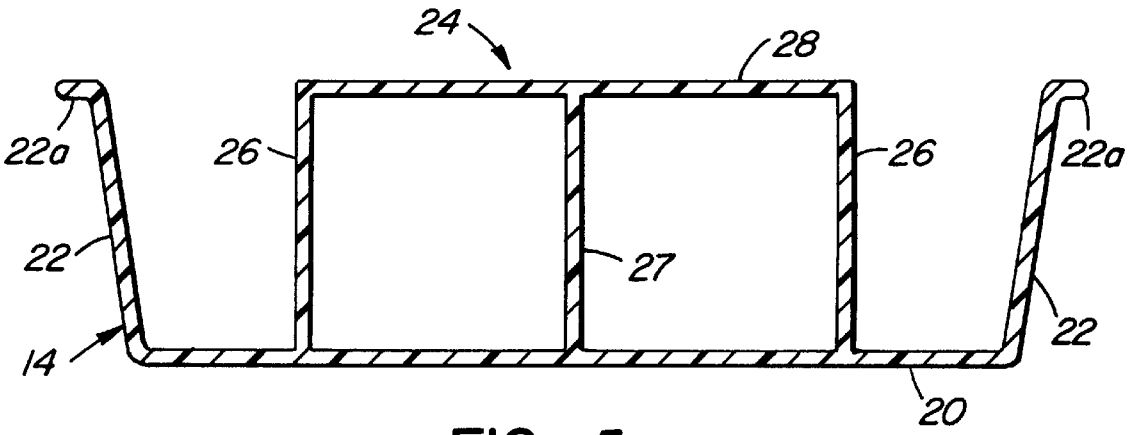

The top plate, shown in FIG. 4, is generally flat, except for inturned side edge elements 30 providing inwards facing grooves shaped to be a snap fit onto the lips 22*a* of the side flanges 22 of the support, and depending ribs 32 which locate against the upper margins of the webs 26. The top plate and support can be snap fitted together, without any holding means being required, the top plate being removable by use of a suitable tool. Although the top plate is formed of the same rigid PVC as the support, since it is largely flat it is capable of being bent longitudinally, and can be supplied in roll form; alternatively it can be supplied in pre-cut lengths. The top plate needs to be made of a plastic composition which is highly resistant to weathering.

In accordance with this invention, the top plate 16 is provided with ribs constituted by the protruding upper portions of rod-like parallel elongated friction elements 35 having their lower portions embedded in the top plate. These friction elements have a roughly circular cross-section of between 0.04 and 0.10 inches diameter, and about half the cross-section of each of these elements, usually about 0.02 to 0.05 inches, protrudes above the generally flat upper surface of the top plate to provide a non-skid surface. Each top plate has five groups of these friction elements, each group comprising four such elements spaced between 0.1 and 0.15 inches apart. Elements 35 are also formed of plastic, and are co-extruded with the main part of the top plate. These elements 35 are however of flexible PVC; i.e. they are formed of PVC having considerably more plasticiser than that of the rigid PVC which forms the rest of the top plate and which is exposed between these elements, and have distinctly greater flexibility. In practice, the hardness of the flexible plastic forming the friction elements 35 will be between 50 and 90 Durometer hardness on the Shore A scale, and preferably less than 75 to 80 on this scale, compared to the rigid PVC of the remainder of the top plate which has a hardness of between 70 and 90 on the Shore D scale. Measurements on the D scale all relate to hardnesses greater than 95 on the A scale. These figures are for instantaneous hardness as tested according to ASTM D2240. The flexible PVC is similar to material used to produce treads of shoe soles, and has sufficient friction that it has a non-skid effect in the longitudinal direction of the flooring member, as well as in the transverse direction.

Figure 3:
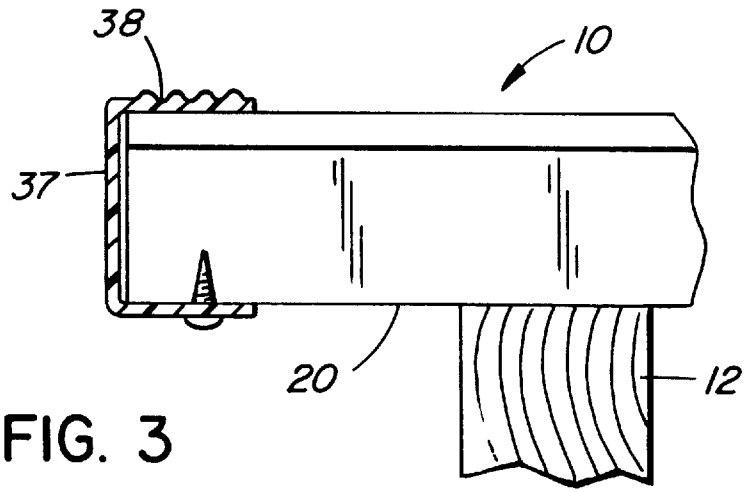
FIG. 3 is a partial longitudinal section of the end of a member.
Figure 2:
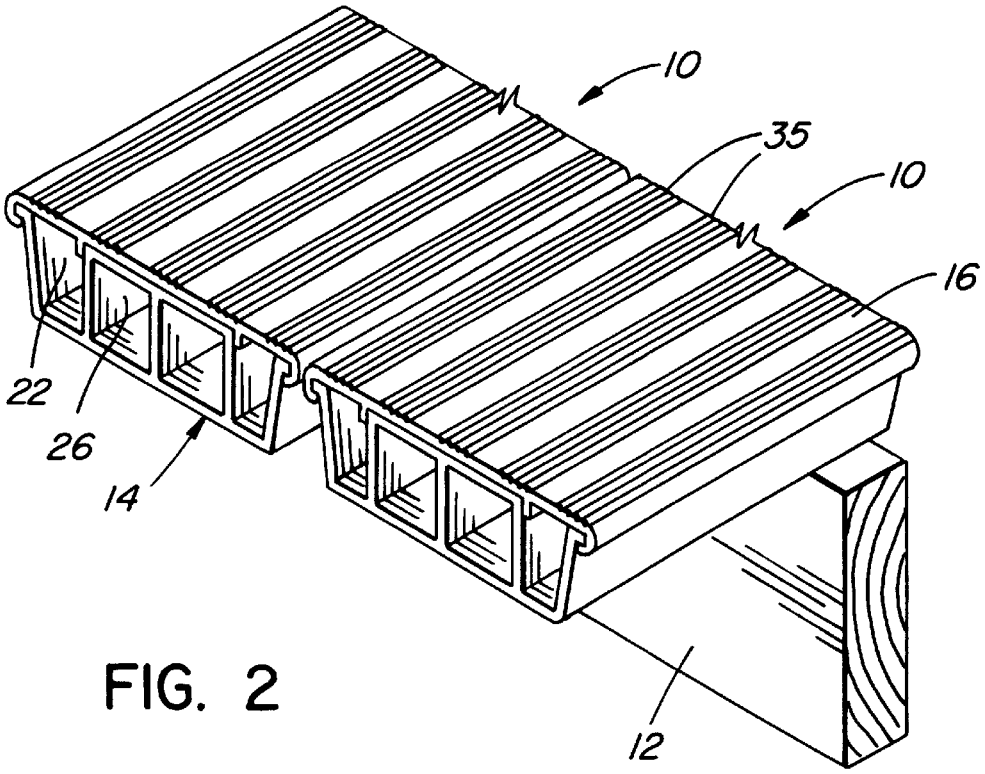
FIG. 2 is a perspective view of the ends of the two members.

After the supports described have been fixed to the joists 12 and assembled with their top plates, the ends are closed by channel members 37 shown in FIG. 3. These channel members, which are also of extruded plastic material, have upper and lower flanges which enclose the upper and lower margins of the ends of the flooring members. The lower flanges are fastened to the base plate 20 by screws. The upper flanges 38 have small longitudinal ribs which also provide a non-skid feature.

Variations are of course possible in the particular dimensions and material to be used. The elongated friction elements 35 may be of different cross-sectional size and shape, for example they may be square or diamond shape in cross-section. What is important is that a proportion of these elements projects above the surface of the top plate by at least 0.02 inches, and amounts of projection up to 0.05 inches may be used. In order not unduly to weaken the top plate, where it bridges the gaps between the side flanges 22 and the support portion 24, the friction elements will not penetrate into this more than ½ its depth. It is not necessary that PVC be used for the top plate and/or friction elements, and the same effect can for example be achieved with ABS plastics, using a small proportion of plasticiser in the main part of the member and more in the elements 35 so that these are of flexible ABS plastic. It is also possible to form the top plate so that it has a thin capstock, of say 0.004 to 0.010 inch thickness, of weatherable plastic having good color uniformity, overlying a base layer of cheaper recycled material.

We claim:

1. An elongated member suitable for flooring, decking, or seating, comprising a top plate formed as an extrusion of plastic material suitable for overlying a support, wherein said top plate includes ribs constituted by protruding portions of parallel, spaced apart, elongated friction elements co-extruded therewith, said friction elements being formed of plastic having distinctly greater softness or flexibility than a main part of the top plate which is exposed between said friction elements and is suitable for providing a non-slip surface;

and wherein the main parts of the top plate are formed of plastic having a hardness of at least 70 Durometer on the Shore D scale, and the friction elements have a hardness of less than 80 on the Shore A scale.

2. An elongated member according to claim 1, wherein said top plate has inturned edge elements for engaging said support.

3. An elongated member suitable for flooring, decking, or seating, comprising:

an elongated support formed as a relatively rigid extrusion of plastic material having a base plate with upstanding side flanges and a longitudinally extending upstanding support portion positioned between said flanges;

a top plate also formed as an extrusion of plastic material and having inturned side edge elements, said side edge elements and the upstanding side flanges having interengaging formations, said top plate bridging gaps between the side flanges and the support portion;

wherein said top plate includes ribs constituted by protruding portions of parallel, spaced apart, elongated friction elements co-extruded therewith, said friction elements being formed of plastic having distinctly greater softness or flexibility than a main part of the top plate which is exposed between said friction elements, said friction elements having a hardness of between 50 and 90 Durometer of the Shore A scale and being suitable for providing a non-slip surface, said friction elements having their lower portions embedded in the top plate and being such as not to penetrate more than ½ the top plate depth.

4. An elongated member according to claim 1, wherein said ribs protrude from the upper surface of the top plate between 0.02 and 0.05 inches.

5. An elongated member according to claim 3, wherein said ribs protrude from the upper surface of the top plate between 0.02 and 0.05 inches.

6. An elongated member according to claim 1, wherein said friction elements are rods which have their lower portions embedded in the top plate.

7. An elongated member according to claim 6, wherein said rods have a diameter of between 0.04 and 0.10 inches diameter of which about one half protrudes from the upper surface of the top plate.

8. An elongated member according to claim 3, wherein said friction elements are rods.

9. An elongated member according to claim 8, wherein said rods have a diameter of between 0.04 and 0.10 inches diameter of which about one half protrudes from the upper surface of the top plate.

10. An elongated member according to claim 1, wherein said top plate is formed of rigid PVC plastic material, and wherein said friction elements are formed from PVC plastic material which has a greater amount of plasticiser than the rigid PVC plastic material.

11. An elongated member according to claim 3, wherein said top plate is formed of rigid PVC plastic material, and wherein said friction elements are formed from PVC plastic material which has a greater amount of plasticiser than the rigid PVC plastic material.

12. An elongated member according to claim 1, wherein said main part of said top plate is formed of rigid ABS plastic material, and wherein said friction elements are formed from ABS plastic material which has a greater amount of plasticiser than the rigid ABS plastic material.

13. An elongated member according to claim 3, wherein said main part of said top plate is formed of rigid ABS plastic material, and wherein said friction elements are formed from ABS plastic material which has a greater amount of plasticiser than the rigid ABS plastic material.

14. An elongated member suitable for flooring, decking, or seating, comprising:

an elongated support formed as a relatively rigid extrusion of plastic material having a base plate with upstanding side flanges and a longitudinally extending upstanding support portion positioned between said flanges;

a top plate also formed as an extrusion of plastic material and having inturned side edge elements, said side edge elements and the upstanding side flanges having interengaging formations;

wherein said top plate includes ribs constituted by protruding portions of parallel, spaced apart, elongated friction elements co-extruded therewith, said friction elements being formed of plastic having distinctly greater softness or flexibility than a main part of the top plate which is exposed between said friction elements and is suitable for providing a non-slip surface, wherein the main parts of the top plate are formed of plastic having a hardness of at least 70 Durometer on the Shore D scale, and the friction elements have a hardness of less than 80 on the Shore A scale.

* * * * *